US005323086A

United States Patent [19]

Shiota

[11] Patent Number: 5,323,086

[45] Date of Patent: Jun. 21, 1994

[54] KLYSTRON HAVING A VACUUM GATE VALVE DISPOSED IN A DRIFT TUBE

[75] Inventor: Masaru Shiota, Hyogo, Japan

[73] Assignee: Mitsubishi Denki Kabushiki Kaisha, Tokyo, Japan

[21] Appl. No.: 944,316

[22] Filed: Sep. 14, 1992

[30] Foreign Application Priority Data

Oct. 22, 1991 [JP] Japan ..... 3-301288

[51] Int. Cl.[5] ..... H01J 25/20

[52] U.S. Cl. ..... 315/5.39; 315/5.51

[58] Field of Search ..... 315/5.39, 5.51; 331/83; 330/44, 45

[56] References Cited

U.S. PATENT DOCUMENTS 3,124,714 3/1964 Bendorf ..... 315/5.39
4,634,925 1/1987 Ieki ..... 313/454

FOREIGN PATENT DOCUMENTS 0039565 3/1979 Japan ..... 315/5.39
62-52832 3/1987 Japan .
0151127 6/1989 Japan ..... 315/5.51

*Primary Examiner*—Benny T. Lee
*Attorney, Agent, or Firm*—Rothwell, Figg, Ernst & Kurz

[57] ABSTRACT

A klystron comprises an electron gun which emits electron beams, a cavity resonator which imparts velocity modulation to the electron beams, a cavity resonator which converts the power of the electron beams into microwave power, a drift tube interconnecting the cavity resonators, and a vacuum gate valve provided on the drift tube.

1 Claim, 1 Drawing Sheet

KLYSTRON HAVING A VACUUM GATE VALVE DISPOSED IN A DRIFT TUBE

BACKGROUND OF THE INVENTION

1. Field of the Invention

The present invention relates to a high power klystron which imparts velocity modulation to electrons in an electron beam for amplification in the microwave region.

2. Description of the Prior Art

A klystron disclosed in Japanese Patent Laid-open No. Sho 62-52832 is shown in FIG. 1 in a sectional view. Referring to FIG. 1, the klystron has an electron gun 1 consisting of a cathode 11, an anode 12, and an insulating glass bulb 13 electrically insulating the cathode 11 from the anode 12. The electron gun 1 emits electron beams 2, and a collector 3 collects the electron beams 2. An input cavity resonator 4 resonates to cause velocity modulation of the electron beams 2 traveling from the electron gun 1 to the collector 3. An output cavity resonator 5 converts the beam power of the electron beams 2 subjected to density modulation for producing a compressional wave during travel through a predetermined distance after velocity modulation into microwave power. A drift tube 6 is interposed between the input cavity resonator 4 and the output cavity resonator 5 to form a drift space for the electron beams 2. The microwave power obtained by the output cavity resonator 5 is guided to an external device by an output waveguide 7. A waveguide vacuum gate valve 8 provided on the output waveguide 7 is closed while the klystron is not in use and is opened while the klystron is in use.

While the klystron is not in use, the waveguide vacuum gate valve 8 is closed to seal the klystron hermetically and the interior of the klystron is kept in a vacuum by an ion pump, not shown.

In using the klystron, the waveguide vacuum gate valve 8 is opened, the interior of the klystron is maintained in a sufficiently high vacuum by the ion pump, and then the cathode 11 of the electron gun 1 starts emitting electrons. Then, the electrons are caused to travel in the form of electron beams 2 by the voltage applied across the cathode 11 and the anode 12 (not shown). While the electron beams 2 travel through the cavity of the input cavity resonator 4, the electron beams 2 are subjected to velocity modulation by the voltage applied to the cavity of the input cavity resonator 4 (not shown). The velocity-modulated electron beams 2 undergo density modulation to produce bunching while the velocity-modulated electron beam 2 travels through a predetermined distance in the drift tube 6. The density-modulated electron beams 2 traveling through the output cavity resonator 5 induces a current and thereby the beam power of the electron beams 2 is converted into microwave power. The collector 3 absorbs the residual power of the electron beams 2.

Since the waveguide vacuum gate 8 is opened while the klystron is used, the microwave power produced by the output cavity resonator 5 is guided through the waveguide vacuum gate valve 8 to an external device by the output waveguide 7.

The waveguide vacuum gate valve 8 included in the prior art klystron thus constructed is required to maintain a vacuum in the electron gun 1 while the klystron is not in use, and to transmit the microwave power smoothly while the klystron is in use. Accordingly, the waveguide vacuum gate valve 8, in general, is of a double choke flange construction, which is complicated and expensive. Moreover, since the waveguide vacuum gate valve 8 is provided on the output waveguide 7, the magnitude of the microwave power that can be transmitted by the output waveguide 7 is limited to a relatively small magnitude by the capacity of the waveguide vacuum gate valve 8.

SUMMARY OF THE INVENTION

It is an object of the present invention to provide an inexpensive, high power klystron of a simple construction, not incorporating any complicated, expensive devices.

The object of the present invention is achieved by an inexpensive, high power klystron comprising a drift tube in which any microwave is produced, an electron gun, and a vacuum gate valve provided on the drift tube. The vacuum gate valve is closed to maintain a vacuum in the electron gun while the klystron is not in use, and the vacuum gate valve is opened to allow electron beams to travel smoothly through the drift tube when the klystron is in use.

The above and other objects, features and advantages of the present invention will become more apparent from the following description taken in connection with the accompanying drawings, which are illustrative and not restrictive and are not to be construed to limit the scope of the present invention.

DETAILED DESCRIPTION OF THE PREFERRED EMBODIMENTS

Figure 1:
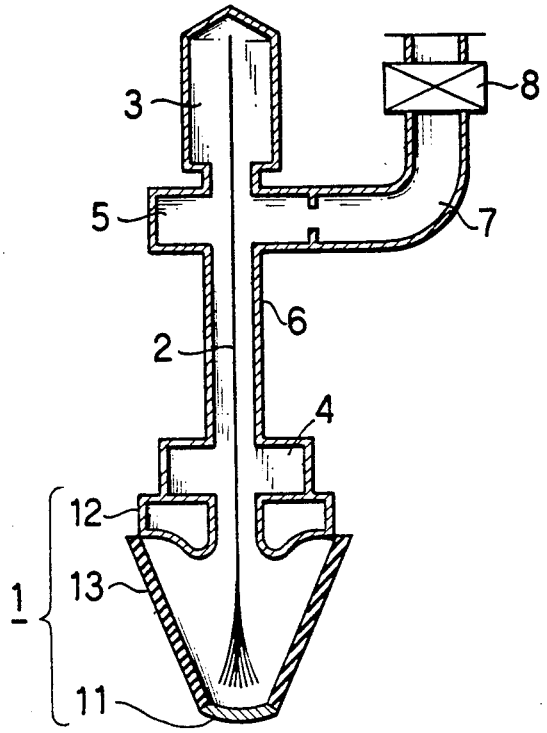
FIG. 1 (PRIOR ART)
FIG. 1 is a sectional view of a prior art klystron.

A klystron in a preferred embodiment according to the present invention will be described in detail with reference to FIG. 2, in which parts like or corresponding to those described previously with reference to FIG. 1 are denoted by the same reference numerals and the description thereof will be omitted.

Figure 2:
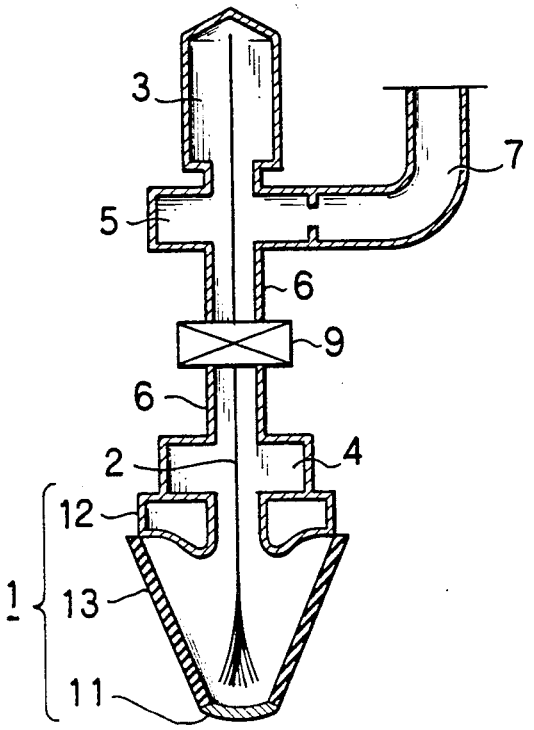
FIG. 2 is a sectional view of a klystron in a preferred embodiment according to the present invention.

Referring to FIG. 2, there are shown an electron gun 1 comprising a cathode 11, an anode 12 and an insulating glass bulb 13, electron beams 2 emitted by the electron gun 1, a collector 3, an input cavity resonator 4, an output cavity resonator 5, a drift tube 6, an output waveguide 7, and a vacuum gate valve 9 of a standard type provided on the drift tube 6.

The vacuum gate valve 9 is closed while the klystron is not in use and is opened while the klystron is in use.

While the klystron is not in use, the vacuum gate valve 9 is closed and the respective interiors of the electron gun 1 and the input cavity resonator 4 are maintained in a vacuum by an ion pump, not shown.

In using the klystron, the vacuum gate valve 9 is opened after the closed space on the side of the collector 3 has been evacuated to a sufficiently high vacuum to enable the electron beams 2 to travel smoothly. Accordingly, the vacuum gate valve 9 needs to have a function to maintain a vacuum and does not need to have a function to serve as a waveguide for smoothly transmitting microwave power. Therefore, the vacuum gate valve may be an ordinary vacuum gate valve.

The input cavity resonator 4 resonates to cause velocity modulation to the electron beams 2 emitted by the electron gun 1, the velocity-modulated electron beams 2 are subjected to bunching in the drift resonator 6, and then the power of the electron beams 2 is converted into microwave power by the output cavity resonator 5. The collector 3 absorbs the residual power of the electron beams 2. The microwave power produced by the output cavity resonator 5 is transmitted through the output waveguide 7 to an external device.

A portion of the klystron, including the cathode 11, the anode 12, the insulating glass bulb 13, the collector 3, the input cavity resonator 4, the output cavity resonator 5, the drift tube 6 and the output waveguide 7 is maintained in a vacuum while the klystron is in use, and a portion of the klystron, including the cathode 11, the anode 12, the input cavity resonator 4, the drift tube 6 and the vacuum gate valve 9 is maintained in a vacuum while the klystron is not in use.

In a modification, the vacuum gate valve 9 may be substituted by a vacuum valve other than vacuum gate valve, such as a vacuum butterfly valve.

As is apparent from the foregoing description, the klystron of the present invention is capable of producing high power and of being fabricated at a relatively low cost, because the vacuum gate valve is provided on the drift tube and hence the vacuum gate valve may be such as having a function to maintain a vacuum and not having a function to serve as a waveguide for transmitting microwave power and because the output waveguide is not provided with any waveguide vacuum gate valve, which restricts the transmission of microwave power.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A klystron comprising: an electron gun which emits electron beams; a collector for collecting the electron beams emitted by the electron gun; a plurality of cavity resonators including at least first and second cavity resonators arranged between the electron gun and the collector; said first cavity resonator being operable to establish a resonant condition to cause velocity modulation of the electron beams traveling from said electron gun and said second cavity resonator being operable to convert the beam power of the modulated electron beams into microwave power; a drift tube interconnecting said first and second cavity resonators and establishing a flow path for said electron beams between said first and second cavity resonators; and a vacuum gate valve positioned in the drift tube between said first and second cavity resonators to control the establishment of a vacuum condition in the portion of said drift tube between said gate valve and said electron gun and in said first cavity resonator and said electron gun.

* * * * *